US008188442B2

(12) United States Patent
Tabrizchi et al.

(10) Patent No.: US 8,188,442 B2
(45) Date of Patent: May 29, 2012

(54) NON-RADIOACTIVE ELECTRON CAPTURE DETECTOR FOR GC

(76) Inventors: Mahmoud Tabrizchi, Isfahan (IR); Hamed Bahrami, Isfahan (IR)

( * ) Notice: Subject to any disclaimer, the term of this patent is extended or adjusted under 35 U.S.C. 154(b) by 321 days.

(21) Appl. No.: 12/479,813

(22) Filed: Jun. 7, 2009

(65) Prior Publication Data

US 2009/0242783 A1 Oct. 1, 2009

(51) Int. Cl.
*H01J 47/00* (2006.01)

(52) U.S. Cl. ..... 250/379

(58) Field of Classification Search ..... 250/424, 250/423 R, 382, 379, 389, 288, 286
See application file for complete search history.

(56) References Cited

U.S. PATENT DOCUMENTS

| | | | | |
|---|---|---|---|---|
| 5,767,683 | A * | 6/1998 | Stearns et al. | 324/464 |
| 6,023,169 | A * | 2/2000 | Budovich et al. | 324/464 |
| 6,429,426 | B1 * | 8/2002 | Doring | 250/288 |
| 2009/0095917 | A1 * | 4/2009 | Doring et al. | 250/424 |

* cited by examiner

*Primary Examiner* — David Porta
*Assistant Examiner* — Faye Boosalis
(74) *Attorney, Agent, or Firm* — Barry Choobin; Choobin & Choobin Consultancy

(57) ABSTRACT

Electron capture detector for use with an effluent stream from a gas chromatograph includes a non-radioactive electron source means and an adjacent ionization chamber in which electron capture take place. The detector comprises two partial chambers, of which one contains the electron source, and the other contains connections for input and output of analysis gas as well as a collector electrode for detecting ions. The collector electrode and the electron source are each of cylindrical configurations, and are coaxially aligned but are spaced apart with respect to each other. The electron current to the collector electrode provides an indication of the presence of electronegative constituents in the gas passing into the second partial chamber.

17 Claims, 3 Drawing Sheets

NON-RADIOACTIVE ELECTRON CAPTURE DETECTOR FOR GC

SPONSORSHIP STATEMENT

The present invention is Sponsord by Isfahan Science and Technology Town (ISTT).

FILED OF THE INVENTION

This invention generally concerns the field of electron capture detectors suitable which can operate in the dc mode or in the pulsed mode. The invention is particularly relates to electron capture detector that is used for gas chromatography analysis of trace electron attaching substances e.g. halogenated organic compounds.

BACKGROUND OF THE INVENTION

For many years, there has been a strong desire to develop gas chromatographic detectors that detect only specific elements. It is well known that a gas chromatographic column is able to separate very similar compounds into separate peaks as a function of time. This time-based separation is especially useful in delineation of adjacent peaks. Once the peaks are separated, it is necessary to identify the constituents of the peaks. Then the concentrations of the compounds within the sample gas input into the GC can be determined.

Among the different types of detectors used for a gas chromatograph, electron capture detectors (ECD) are useful for the detection of electron attaching compounds, such as halogens and nitro compounds. ECD has been used as a GC detector for more than four decades, because it offers the highest sensitivity to electron-capturing compounds. This selective sensitivity to halides makes the detection method especially valuable for the trace analysis of many environmentally important organic compounds such as pesticides. ECD is the only detector that detects CFCs and chlorine-containing pesticides at trace levels.

Conventional ECDs usually use a radioactive ionization source in form of $^{63}$Ni foil, e.g. in U.S. Pat. No. 4,063,156. Using such ionization source has some benefits, mostly because of simplicity, stability, noise-free and no need to extra power for ionization. However, there are some real problems associated with using radioactive materials. Usually working with such materials is not very safe and there is always a risk of radioactive contamination. Thus regular leak test and special safety regulations are required. Therefore licensing and waste disposal are required which limits the acceptance of GCs equipped with such detectors in the market place. Another problem which is associated whit the use of a radioactive isotope is that in case of depositing unwanted materials, the interior of detection cell cannot be washed easily because it requires a special technology.

The other sources of electron formation that have been investigated include the following: (1) a thermo emitter such as in U.S. Pat. No. 6,023,169 ; (2) an activated photocathode such as in U.S. Pat. No. 7,015,467 ; (3) a hydrogen Lyman a emission such as paper by Wentworth, W. E. (J. Chromatograph. A, 112, P. 229,1975); (4) a rare gas resonance lamp source with an $MgF_2$ window such as paper by Kapila, S. (J. Chromatograph. A, 259, P. 205,1983) and (5) a pulsed discharge in pure helium such as in paper by Huamin Cai (Anal. Chem. 1996,68,1233-1244). None of these non-radioactive sources has successfully replaced the radioactive material except the pulsed discharge detector. Operation of the latest one is in this way. An electrical discharge occurs in a flow of helium gas and generates high-energy photons coming from $He_2$ emission in the range of 60-110 nm. The high-energy photons ionize a dopant gas to produce free electrons. These electrons move toward the collecting electrode along the biased path, forming a constant standing current. When electron attaching substances present in the effluent of GC the electron current is reduced.

Corona discharge is a relatively low-power electrical discharge that takes place at atmospheric pressure. It is generated by applying a high voltage to a sharp metal point that can create a stream of electrons, ionize the carrier gas molecules, and provide a high concentration of ions.

There are two types of corona discharges depending on the polarity of the electrode surrounded by corona which is negative or positive. The discharge current for negative corona in non-electron attaching gases such as nitrogen, helium and argon is exceptionally more than hundred times higher than that of the positive corona or even negative corona in for example air. The high current observed for the negative corona in pure nitrogen or helium can be explained considering the mechanism of the negative corona discharge. In a point-to-plane geometry, the electric field is very strong in the vicinity of the tip. At a sufficient voltage, electrons leaving the negative point are multiplied due to electron impact ionization of the gas molecules. Positive ions hitting the negative tip knock out more electrons and ensure the reproduction of electrons removed by the field.

In fact, when the needle is negative and the buffer gas is nitrogen, the needle produces a huge number of electrons such that the discharge current grows as high as 200 μA. The presence of any electron attaching substance suppresses the discharge and quenches the production of electrons. In this invention such type of corona discharge is used and the detector is specially designed such that the sample will not interfere with the discharge. Thus electrons are continuously produced regardless of the presence of electron attaching substances. Such electron source has already been used by Tabrizchi et all as an ionization source for negative ion mobility spectrometry ("*A Novel use of Negative Ion Mobility Spectrometry for Measuring Electron Attachment Rates*" M. Tabrizchi, A. Abedi, Journal of Physical Chemistry A, 108(30), (2004), 6319-6324).

In this invention the negative corona discharge in nitrogen or other non-electron attaching gases is used to provide a novel electron capture detector for GC. This electron source provides an ECD of quite robust, chemically inert and capable of operating up to 400° C.

SUMMARY OF THE INVENTION

This objective is achieved by a cylindrical ECD with two partial chambers, separated by a partition with a small hole, a negative corona discharge in nitrogen as the non-radioactive source being arranged in the first partial chamber, a cylindrical collector located in the second partial chamber with an input and output for the GC effluent, means for causing the gas to flow through the detector, and means for applying a voltages to the electrodes and means for heating the detector.

In this design the electron source is separated from the ionization region so that the sample which may exist in the GC effluent can not enter the electron source.

The objective is achieved completely in this way.

Since the electron source is located in a separate space, any contact of the sample gas with the interior space of the electron source is prevented by a flow of nitrogen gas through the electron source. This guaranties stable continues production of electrons regardless of the constituents in the second partial chamber. Electrons, however enters the second partial chamber where negative ions are formed by electron attachment to neutral molecules.

DESCRIPTION OF THE EMBODIMENT

Figure 1:
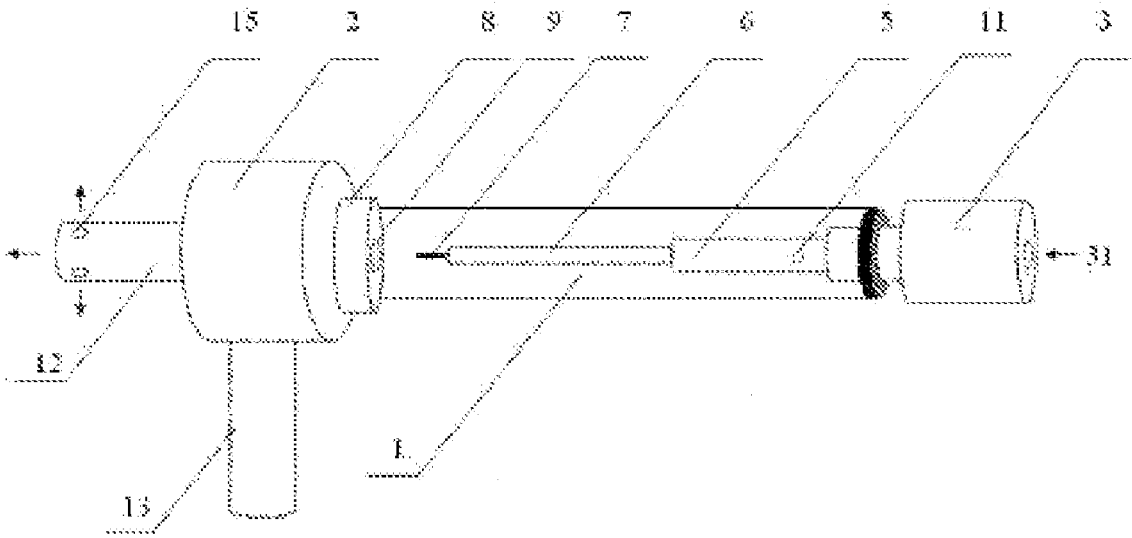
FIG. 1 is a longitudinal section of an electron capture detector embodying this invention.

The ECD in the embodiment shown in FIG. 1 consist of two partial chambers 1 and 2, separated by a partition 8 containing a small hole to conduct electrons. The first partial chamber 1 is preferably made of glass tube which is ended by means for gas inlet 3 and the partition 8. The second partial chamber 2 is made of PTFE Teflon (or ceramic), which is ended by the partition 8 and the collector electrode 12, also means for getting fed from the output of chromatography column 13. In the first partial chamber 1 corona discharge is created between a sharp needle 7 and a disc plate 8 by applying an electric potential and flow of nitrogen or helium gas 31.

The electrons which are created in the gap between these two electrodes are accelerated by the electric field generated by the accelerating voltage source to collect enough energy to move into the volume of the second partial chamber 2, where they intract with the molecules of analyt that supplied through feed line 13. If molecules from electron attaching substances are present in the analysis gas which thereby attach electrons, the electric current (signal) tapped at collector electrode 12 is changed in proportion to the concentration of these molecules.

The corona discharge is created in the first partial chamber between a telescopic shape needle and a perforated plate electrode 8. This telescopic structure is made of two consecutive stainless steel cylinder 5 and 6 along with a needle 7. The bigger cylinder 5 is 20 mm long×1.1 mm i.d. on which there is a hole 11 for entrance of discharge gas. while the smaller one 6 is 18 mm long×0.8 mm i.d. the needle 7 itself is a tiny golden wire (0.05 mm in diameter) which is passed through the two cylinders 5 and 6 and comes out about 2 mm from end of the structure. With this structure the position of the golden wire 7 can be adjusted to the center of the plate electrode 8. The plate electrode 8 is a disk like aluminum piece in center of which there is a hole 9.

Application of a thin gold wire 7 as the tip stabilized the discharge and gave a constant current. This is probably due to the higher efficiency of electron emission by metastable molecule bombardment for the case of gold.

In order to prevent leaking air into the first partial chamber 1 the two end of glass tube where the electrodes are fixed, are ceiled by suitable O-rings.

Figure 2:
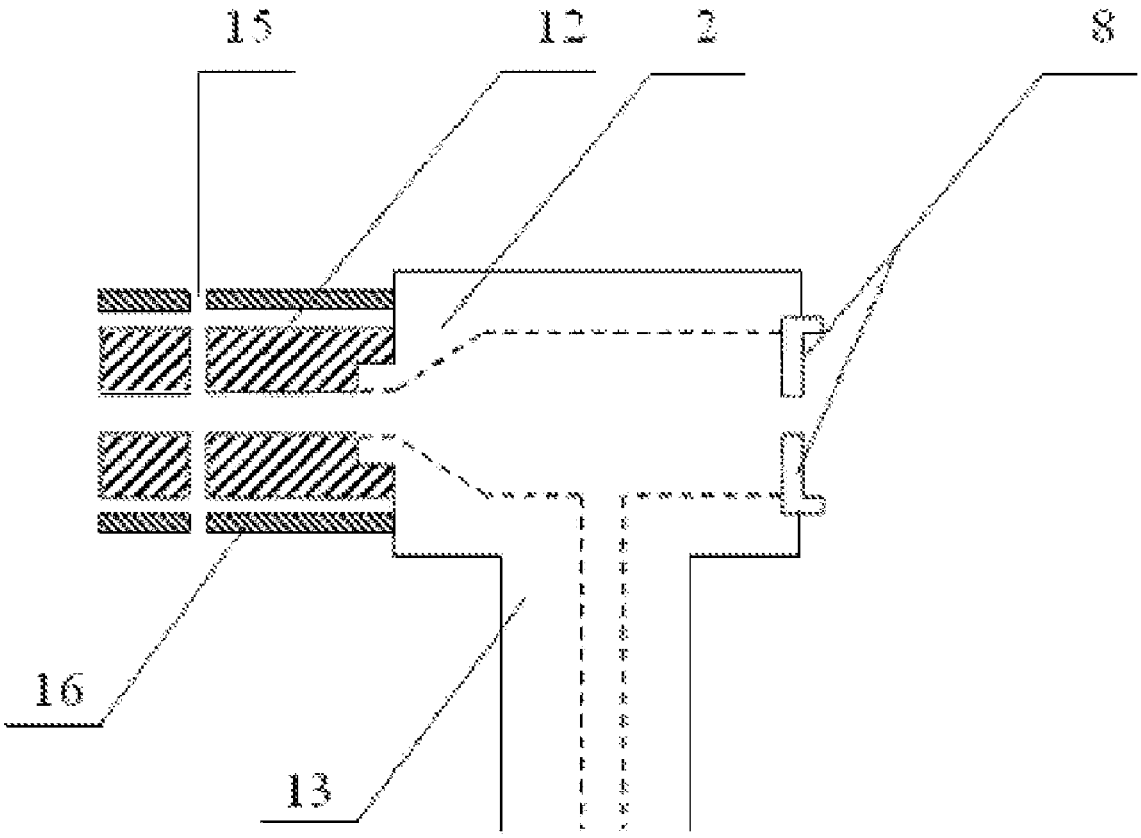
FIG. 2 is a schematic cross-sectional view of second partial chamber of the electron capture detector embodying this invention.

The second partial chamber 2 which is shown in FIG. 2 is preferably made of an electrically insulating material such as Teflon having sufficient rigidity to support the facing ends of the feed tube 13, the disc plate 8 and the collector electrode 12. This section also provides an isolative path between plate electrode of the electron source 8 and collector electrode 12.

The collector electrode 12 is preferably a metallic cylinderical member having two holes 15 which provide gas outflow 15 (to withdraw the gas). The collector electrode is made of electrically conductive material such as bronze which is shielded by another metallic cylinderical member 16 connected to ground.

Figure 3:
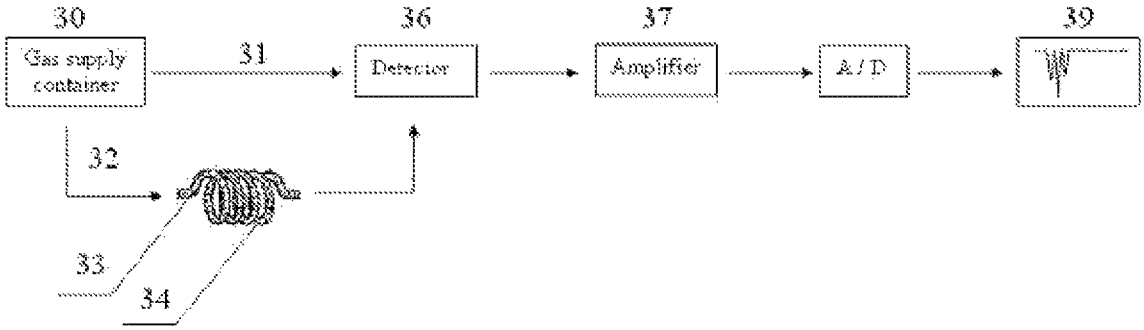
FIG. 3 is a diagrammatic view of a gas chromatographic system incorporating the electron capture detector of this invention.

FIG. 3 shows a gas chromatographic system, which incorporates the electron capture detector of this invention.

The system includes a pressurized container 30 for storing a supply of carrier gas, such as nitrogen or helium. The container 30 delivers two stream of gas 31 and 32 to detector 36 as discharge gas and chromatographic column 34 as carrier gas. Sample is added to carrier gas stream via an injection port 33 located in the beginning of chromatographic column 34. Stationary phase material within the column 34 adsorbs some or all of the constituents of the sample in varying degrees, such that the effluent from the column 34 exhibits a particular measurable property that is a time-varying function of the nature and amount of the constituents of the sample. A detector 36 which is of the electron capture type senses variations in this measurable property of the effluent, and actuate an amplifier 37 for providing a permanent record 39 of the time variations of this measurable property.

It is the feature of this invention that the detector 36 performs well using relatively inexpensive and widely available nitrogen as the discharge 31 and carrier gas 32. The system also includes two flow meters for adjusting the flow rates of the discharge 31 and the carrier gas 32 toward the detector 36 and column 34. In case helium is used as the carrier gas of the chromatograph, it can also be used as the discharge gas for the detector.

The column 34 contains a stationary phase material. The stationary phase is chosen for its property of differentially adsorbing certain substances, preferably the anticipated constituents of the sample. By reason of such differential adsorption, at least one property of the effluent from the column 34 is caused to vary as a function of time. The time function is related to the capability of the stationary phase to adsorb the constituents of the sample.

Figure 4:
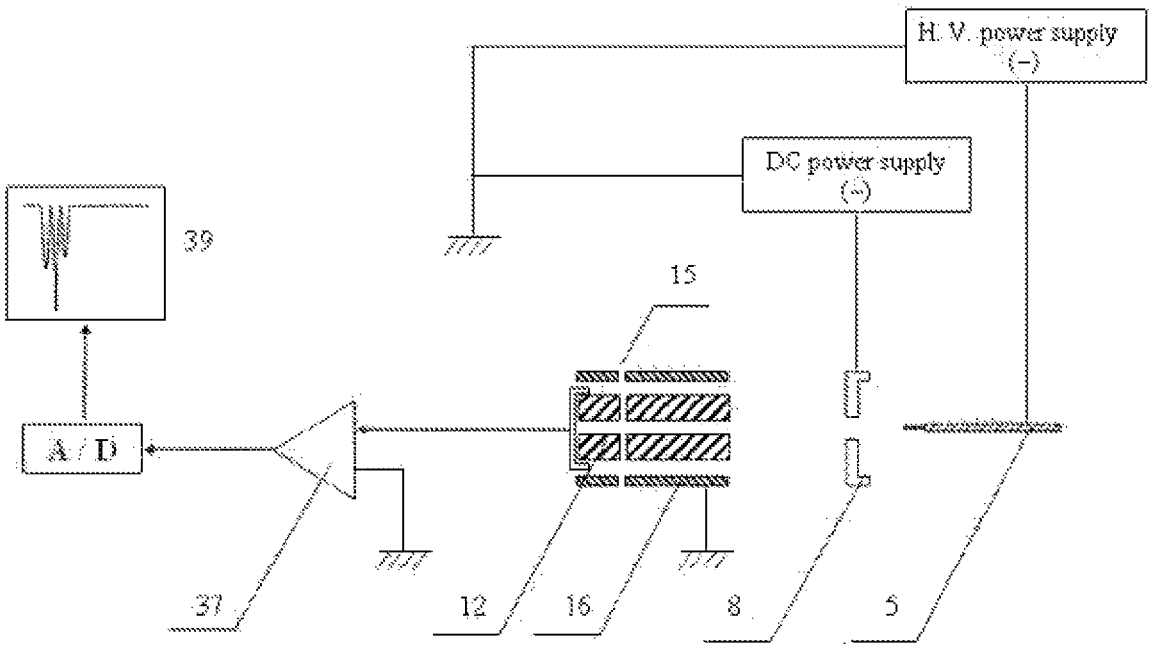
FIG. 4 is a schematic block diagram of electric circuit of the electron capture detector embodying this invention.

Electronic circuitry used in this invention is shown in FIG. 4. A high voltage direct current (DC) power supply employed for generating the corona discharge, which its negative pole was connected to the first part of the needle structure 5. Applying 3300V different of electrical potential is sufficient to establish a permanent corona discharge. Another electronic circuitry is connected to the perforated plate 8 and to the collector electrode 12 for establishing an electric field so as to causes the free electrons generated by the ionization process in the first partial chamber 1 to migrate toward the collector electrode 12 (i.e., in the direction of gas flow), and to measure the rate of such electron migration. A DC power supply was used for this purpose. Supplying 30V different of electrical potential is enough to gather a suitable current at collector electrode 12.

An amplifier 37 is connected by suitable electronic circuitry to the collector 12 so as to indicate the time varying capability of the ionized effluent to capture free electrons. For heating the detector a coil of filament surrounding the feed line 13 and second partial chamber 2 was used. The two ends of this coil are connected to poles of a regulated DC power supply.

The description of the embodiment set forth above is intended to be illustrative rather than exhaustive of the present invention. It should be appreciated that those of ordinary skill in the art may make certain modifications, additions or changes to the described embodiment without departing from the spirit and scope of this invention as claimed hereinafter.

What is claimed is:

1. An electron capture detector consisting of: a non-radioactive source for generating electrons;

a reaction chamber comprising a first and a second partial chamber; a collector electrode disposed externally of said second partial chamber;

a means for applying a difference of electrical potential between electron source and collector electrode;

a means for allowing a predetermined amount of gas wherein said gas comprises a predetermined amount of discharge and carrier gas to flow through the detector and said carrier gas comprises analysis gas that is passed through a gas chromatography (GC) column including stationary phase material, wherein said analysis gas exhibits a particular measurable property that is a time-varying function of the nature and amount of the constituents of the analysis gas;

a means for heating the detector;

a means for displaying an output from said detector.

2. The electron capture detector of claim 1, wherein said first and said second partial chamber are separated by a partition which conducts electrons.

3. The electron capture detector of claim 2, wherein the partition is a perforated plate.

4. The electron capture detector of claim 1, wherein the second partial chamber comprises an input line that feeds said analysis gas from said GC column and an output line through which an analysis substance is removed from the said partial chamber.

5. The electron capture detector of claim 1, wherein the partition functions as a target electrode in creation of corona discharge.

6. The electron capture detector of claim 1, wherein the second partial chamber establishes the ionization region and is made of PTFE Teflon (or ceramic).

7. The electron capture detector of claim 1 wherein the collector electrode has a cylindrical shape and is made of metal.

8. The electron capture detector of claim 1, wherein the heating mean consists of a coil of filament which is connected to poles of a regulated DC power supply.

9. The electron capture detector of claim 1, wherein the flow of discharge and carrier gas are controlled by two discrete flow meter.

10. The electron capture detector of claim 1, wherein the non-radioactive electron source comprises of a corona discharge in nitrogen or in helium, and wherein said corona discharge is between a needle structure and a plate electrode.

11. The non-radioactive electron source of claim 10, wherein the corona discharge is formed by applying a voltage to said electrodes.

12. The non-radioactive electron source of claim 10, wherein the needle structure consists of a first stainless steel tube, a second stainless steel tube and a needle, and wherein said second stainless steel tube is inserted into said first stainless steel tube and wherein said needle is inserted into said second stainless steel tube.

13. The non-radioactive electron source of claim 10, wherein said needle comprises of a golden wire.

14. The non-radioactive electron source of claim 10, wherein the first stainless still tube comprises of an aperture to allow exiting of said discharge gas to said first partial chamber.

15. The non-radioactive electron source of claim 10, wherein the plate electrode comprises of a disk shape which is made of aluminum with a hole for transmission of electrons.

16. The non-radioactive electron source of claim 10, wherein the golden wire is positioned at center of the hole of the plate electrode.

17. The non-radioactive electron source of claim 10, wherein the discharge gas is nitrogen or helium which prevents entrance of carrier gas containing a sample substance to the first partial chamber.

* * * * *